US011800962B2

(12) United States Patent
Zorzo

(10) Patent No.: US 11,800,962 B2
(45) Date of Patent: Oct. 31, 2023

(54) BASE FOR MOPS WITH CLEANING CLOTH

(71) Applicant: TTS CLEANING S.R.L., S. Giustina in Colle (IT)

(72) Inventor: Marco Zorzo, S. Giustina in Colle (IT)

( * ) Notice: Subject to any disclaimer, the term of this patent is extended or adjusted under 35 U.S.C. 154(b) by 396 days.

(21) Appl. No.: 17/054,021

(22) PCT Filed: May 6, 2019

(86) PCT No.: PCT/IB2019/053675
§ 371 (c)(1),
(2) Date: Nov. 9, 2020

(87) PCT Pub. No.: WO2019/215573
PCT Pub. Date: Nov. 14, 2019

(65) Prior Publication Data

US 2021/0235959 A1 Aug. 5, 2021

(30) Foreign Application Priority Data

May 8, 2018 (IT) ..... 102018000005171

(51) Int. Cl.
*A47L 13/256* (2006.01)
*A47L 13/258* (2006.01)
*A47L 13/44* (2006.01)

(52) U.S. Cl.
CPC ..... *A47L 13/256* (2013.01); *A47L 13/258* (2013.01); *A47L 13/44* (2013.01)

(58) Field of Classification Search
CPC ..... A47L 13/256; A47L 13/258; A47L 13/44
See application file for complete search history.

(56) References Cited

U.S. PATENT DOCUMENTS 4,991,250 A * 2/1991 Young ..... A47L 13/46 15/228
5,926,896 A 7/1999 Allemann et al.
8,561,251 B2 * 10/2013 Lindner ..... A47L 13/20 15/228
9,943,207 B1 4/2018 Patterson

FOREIGN PATENT DOCUMENTS

EP 0370698 A1 5/1990
EP 1245179 A2 10/2002
GB 2503908 A 1/2014

* cited by examiner

*Primary Examiner* — Shay Karls
(74) *Attorney, Agent, or Firm* — QUICKPATENTS, LLC; Kevin Prince

(57) ABSTRACT

A mop base that is particularly practical in its use, above all when releasing a cloth retained along its transverse edges.

10 Claims, 7 Drawing Sheets

BASE FOR MOPS WITH CLEANING CLOTH

CROSS-REFERENCE TO RELATED APPLICATIONS

This application claims the benefit of Italian Patent Application 102018000005171, filed on May 8, 2018, and PCT Application PCT/IB2019/053675, filed on May 6, 2019, both incorporated herein by reference.

STATEMENT REGARDING FEDERALLY SPONSORED RESEARCH AND DEVELOPMENT

Not Applicable.

FIELD OF THE INVENTION

The object of the present invention relates to a mop base that is particularly practical in its use, above all when releasing the cloth retained along its transverse edges.

BACKGROUND

It is well known that mop bases have undergone considerable modifications over time, sometimes to be more comfortable for the operator, many times to be cheaper to produce, and sometimes only to appear to be shaped in a more pleasant way for marketing purposes.

Of course the changes brought to the bases to be used in a more practical way are not always welcomed by operators, due to the natural reluctance to change their usual cleaning operations, the only changes made to the structure of mop bases that have been favorably received by operators are those for which it is possible to immediately appreciate the improved ergonomics.

While in the past the mops remained for a long time connected to the relative bases on their active surfaces, i.e. with the surfaces with which the dry mops were brought in contact with the floor, and they were pressed by the corresponding active surface of the base, and subsequently they were rinsed and squeezed in different ways, nowadays more flexibility is sought, with easier rinsing and replacement.

In fact the mop bases of the known art were designed specifically for only one function, that of getting the mops ready to be washed and those that replace them.

A mop base of a known type, and corresponding to the object of the invention, has a pair of half-frames, hinged to the base, which are held in a constrained flat configuration, defined as working, and holds the relative cloth at the ends of the free transverse sides by means of coupling devices; in order to change the cloth, the aforesaid configuration must be modified, into a maintenance configuration, letting the aforesaid half-frames rotate downwards, where they are hinged at the top, letting the mop descend in a detached manner from the base and held to it only at its transverse ends.

A particular mop base of the known type, and corresponding to the one that is the object of the invention, has coupling devices, located near the transverse edges of the half-frames, and placed on the external surfaces, with respect to the internal active ones, to connect the transverse ends of the mops.

These known coupling devices comprise a double lever, with a fulcrum axis parallel to the transverse edge, with a first lever facing the free end of the half-frame, held against the relative half-frame by elastic devices, to constitute the inlet and retention opening of the transverse end side of the cloth and the second lever, opposite the first lever, with respect to the fulcrum, spaced with respect to the outer surface of the half-frame, and which can be brought closer to the half-frame with a rotation movement with respect to the fulcrum which exceeds the elastic force of said elastic devices, and consequently to open wide the inlet mouth; said inlet being a gripper that is normally held closed by the action of said elastic devices for retaining the transverse end of the cloth.

As already stated, however, the retention of a laminar tab by known coupling devices was precarious, and above all very difficult to use when releasing the cloth.

The bases of the known art of the aforementioned type require a manual intervention which provides for the cloth to be handled in the event that it needs to be replaced.

This means that the operator must approach the base, possibly by hand or with a foot control, render the base suitable for being disconnected from the relative mop, disconnect the coupling points and remove the dirty mop, contaminating the hands of the operator.

This numerous sequence of operations in the past was considered inevitable and accepted by the operators, since there was no other solution available.

It must also be said that although manufacturers have been committed to helping the operator in the above-mentioned operations for changing the cloth, this task was in any case rather complex, and expensive due to the time taken to complete, and which necessarily involved the execution of a multiplicity of operations having to operate, while holding the handle that was fixed to the base with one hand, with the other hand first on one side and then on the opposite side to free the retaining ends of the opposite retention and tensioning parts.

In fact the normal coupling steps provided that the end part of the mop, to be joined along the transverse edges, had to be first inserted within an insertion space, then made to coincide with retention devices and finally moved and connected with said retention devices (therefore having at least two orthogonal movements between them) and at the end secured by a safety element which made sure that the disengagement raising of the restraining devices did not happen.

In fact, in previous embodiments the method of joining the aforementioned mops by means of a simple slotting into a laminar seat as narrow as the thickness of the mop, to then be simply tightened by a gripper against the extraction, had performed badly since it did not ensure the mop seal, when this over time was shortened as a result of continuous washing.

SUMMARY OF THE INVENTION

The object of the present invention is to make available a mop base which is ergonomically configured and a cleaning cloth with a specially configured connection end for releasing the cleaning cloth retained on each side transversal to the relative base (hereinafter also a new base) which can overcome all the drawbacks of the prior art described above.

A primary object of the present invention is to make available a new mop base that can be more practical for operators in its use with the respective cleaning cloth.

An important object of the present invention is to make available a new base whose couplings can be controlled for removing said cleaning cloth from its base, for its replacement, without being in any way handled by the operator, and therefore without the operator touching said cloth in any way with his own hands and thereby contaminating his hands with the dirty cloth.

A further object of the present invention is to make available a new base for mops which allows the above operations to be carried out quickly and easily.

Another object of the present invention is to make available a new mop base which allows said cleaning cloth to be removed with the minimum number of operations.

An important object of the present invention is to make available a new mop base which allows all the above operations to be carried out with just one free hand if necessary.

Explanation of the Invention

These objects and those which will appear better in the following description are achieved by a base for mops and by a cleaning cloth to be retained on said mop base by coupling devices and having, at the transverse ends connecting to the mop base, coupling tabs, where said coupling tabs have a lamina with an enlarged end, and have an end enlargement of the free edge end that is thicker than the thickness of said lamina, and where said mop base configured to retain in a removable manner said cleaning cloth, and including a pair of half-frames each of which is hinged to a central connecting element of said base for rotating said half-frames between a flat position and a reclined position where said half-frames are brought close to each other; on each of said half-frames near the free transverse edge, is hinged said coupling device comprising a lever characterized by the fact that between a first arm and said lever, and the outer surface of the half-frame there remains a cavity with a cross-section corresponding to the end enlargement of the transverse edge of the cloth which is configured with an end enlargement and that tapers into a lamina joining the body of the cloth, coming out from said cavity through an inlet mouth, defined with at least one retaining wall either on the free end of the first arm of said lever and/or on the free transverse edge of a half-frame, where when said first arm of the lever is pressed to close the inlet mouth, by means of the elastic devices acting on the second arm of said lever; where said at least one retaining wall near the inlet mouth facing the hinging fulcrum of said lever, with a position perpendicular to the tab that crosses said inlet mouth and that is connected with the outer wall of the enlarged end of the tab for retaining the transverse side of the cloth.

Advantageous Characteristics of the Invention

Advantageously, said cavity underlies the first arm of the lever, with a shaping of the same and/or of the outer surface of the half-frame resulting in the whole thing being compact and not taking up much space.

Advantageously, the coupling devices, with the half-frames rotated in a lowered manner and close together by the juxtaposition of the respective active surfaces, in the maintenance configuration, are in a specular position in order to be operated by overcoming the elastic forces of the respective elastic devices acting on the second arm of said levers with two pressure forces of an opposite and contrary direction, in order to be able to simultaneously attain the manipulation action with just a single hand of the operator.

Advantageously, the half-frames, from the flat condition, released from the mechanical restraint of the base, are arranged so that they are set next to each other freely oscillating downwards in the maintenance configuration, with the relative hanging cloth held at the ends of the transverse sides, following the pressure on the second lever of the coupling devices, the inlet opens, opening wider than the thickness of the enlarged end of the lamina, opening the cavity, and the cloth because of its own weight is released from the base, falling down.

Advantageously, said retention devices are of the hinged lever type, an arm of this lever is the operating lever and the counter-posed arm is the retention device of the tab of the cloth on the transverse side of the cloth, preferably cantilevered.

Advantageously, the actuation lever is held under constant strain by elastic devices which keep it away from the surface of the half-frame, and the opposite end of the lever with constant pressure, due to the aforementioned elastic devices, holds the relative tab of the mop, pressed for holding against the surface of the half-frame.

Advantageously, the retention device is a gripper with one side consisting of the half-frame and the opposite side consisting of an arm of the retention lever.

Advantageously, the cloth retention device is composed of the connection between the cavity and the relative enlargement of the end part of the lamina on the transverse sides of the cloth, the relative mouth being able to open wider than the enlargement for the insertion of the said enlargement within the aforesaid seat.

Advantageously, said tab of the cloth includes a lamina that protrudes from the transverse side of the cloth and ends at the free end with an enlargement that is thicker than the lamina and preferably with a thickness three time greater than the lamina, to ensure the secure retention of the enlargement inside said cavity. Advantageously, the process for releasing the cloth joined to the base that is the object of the invention is carried out according to the following steps:

- release of the half-frames from the constrained work position into the maintenance position by acting on the mechanical constraint in a straight flat configuration;
- juxtaposition of the active surfaces of the half-frames at the minimum distance or in support;
- pressure on the second arms of the levers of the retention devices with two opposite actions and in an opposite direction for opening the clamping mouth of the tab, up to a more extensive widening than the enlarged end of the lamina retained within the cavity seat;
- release of the cloth from the retention on the two transverse ends of the base, which then falls under its own weight, without any manual intervention on the cloth itself.

Advantageously, the process for attaching the cloth to the base is achieved automatically with the following steps:

- opening of the inlet mouth, consisting of the first arm of the lever of the coupling device, by applying pressure on the second arm of the lever opposite, overcoming the elastic force of the elastic devices, opening it at least with an opening equal to or greater than the thickness of the enlarged end of the tab joined to the transverse side of the mop;
- inserting the tab with a movement parallel to the axis of the tab, bringing the enlarged end into the cavity underlying the first lever arm;
- release of the second lever arm from the pressure exerted previously, allowing the elastic devices to close the inlet mouth by clamping the tab and allowing the cavity, which constitutes the enlargement seat, to join with said enlargement, thereby retaining it;

all this without any additional and different movements of the cloth to encounter corresponding elements or studs or other constraints, or different movements of direction (with respect to the insertion movement shown above only) to connect with parts of the base, before intervening on the various coupling systems.

Advantageously, the process for attaching the cloth to the base is automatically achieved with the same steps set out above, modified for the step of opening of the mouth carried out following a pressure on the inlet mouth by the tab, which opens the inlet mouth and penetrates inside the cavity;

all without the operator having to exert any pushing action on the second lever arm to be able to raise the first lever arm with the consequent opening of the mouth.

These and other objects are all attained by the mop base with automatic coupling and facilitated release that is the object of the present invention according to the attached claims.

BRIEF DESCRIPTION OF THE DRAWINGS

The technical characteristics of the invention, according to the aforesaid objects, can clearly be seen in the content of the claims below, and its advantages will become more readily apparent in the detailed description that follows, made with reference to the accompanying drawings, which illustrate a preferred embodiment, which is purely exemplary and not limiting, in which:

DETAILED DESCRIPTION OF AN EXAMPLE OF A PREFERRED EMBODIMENT

Figure 1:
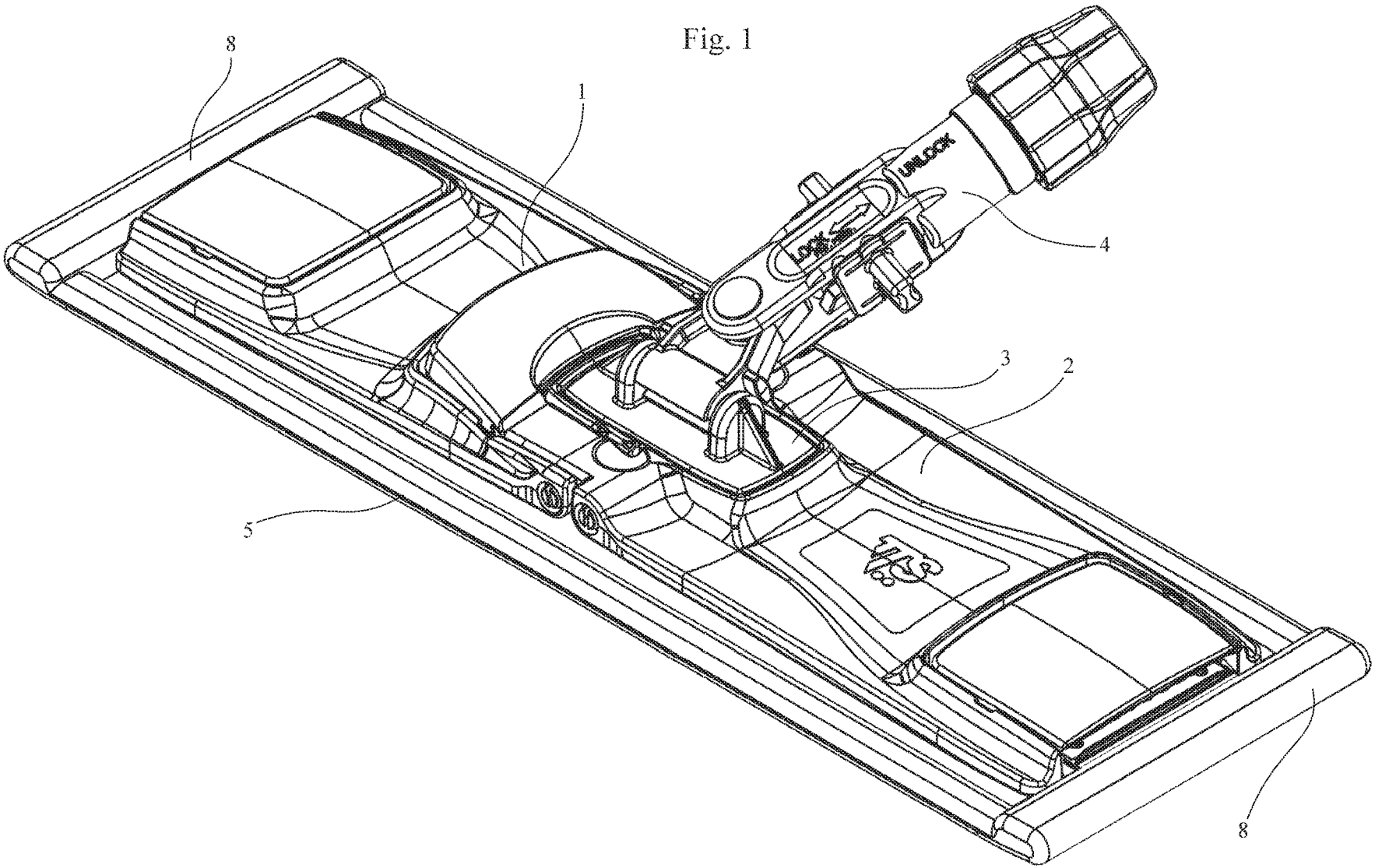
FIG. 1 shows a mop base in the working configuration, comprising two half-frames constrained in a planar and rectilinear arrangement to which, on the active surfaces, a cleaning cloth is connected.
Figure 2:
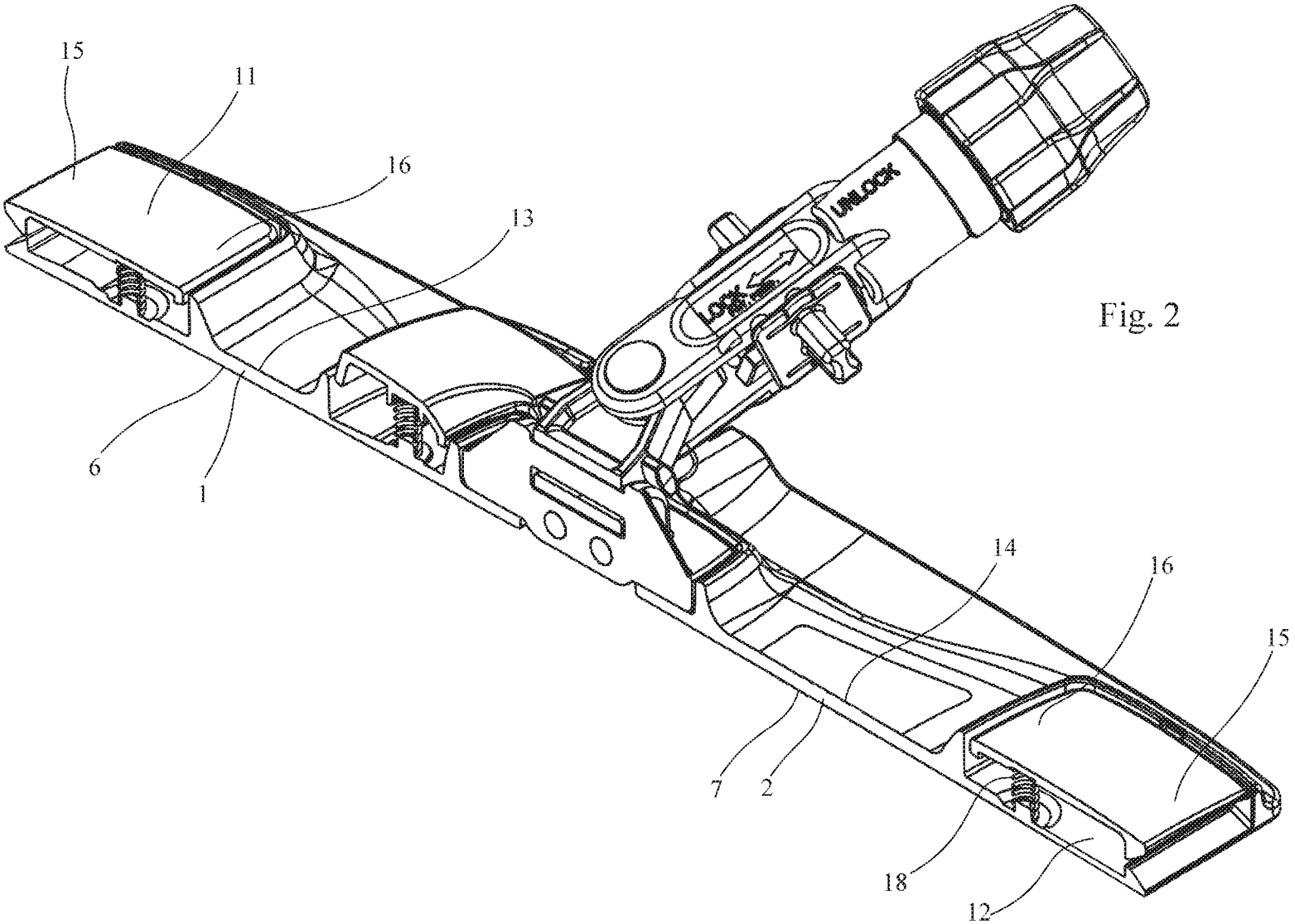
FIG. 2 shows the device of FIG. 1 according to a section view of a vertical longitudinal plane without the relative cloth, from which the positioning of the coupling devices located at the transverse ends of the half-frames is evident.
Figure 3:
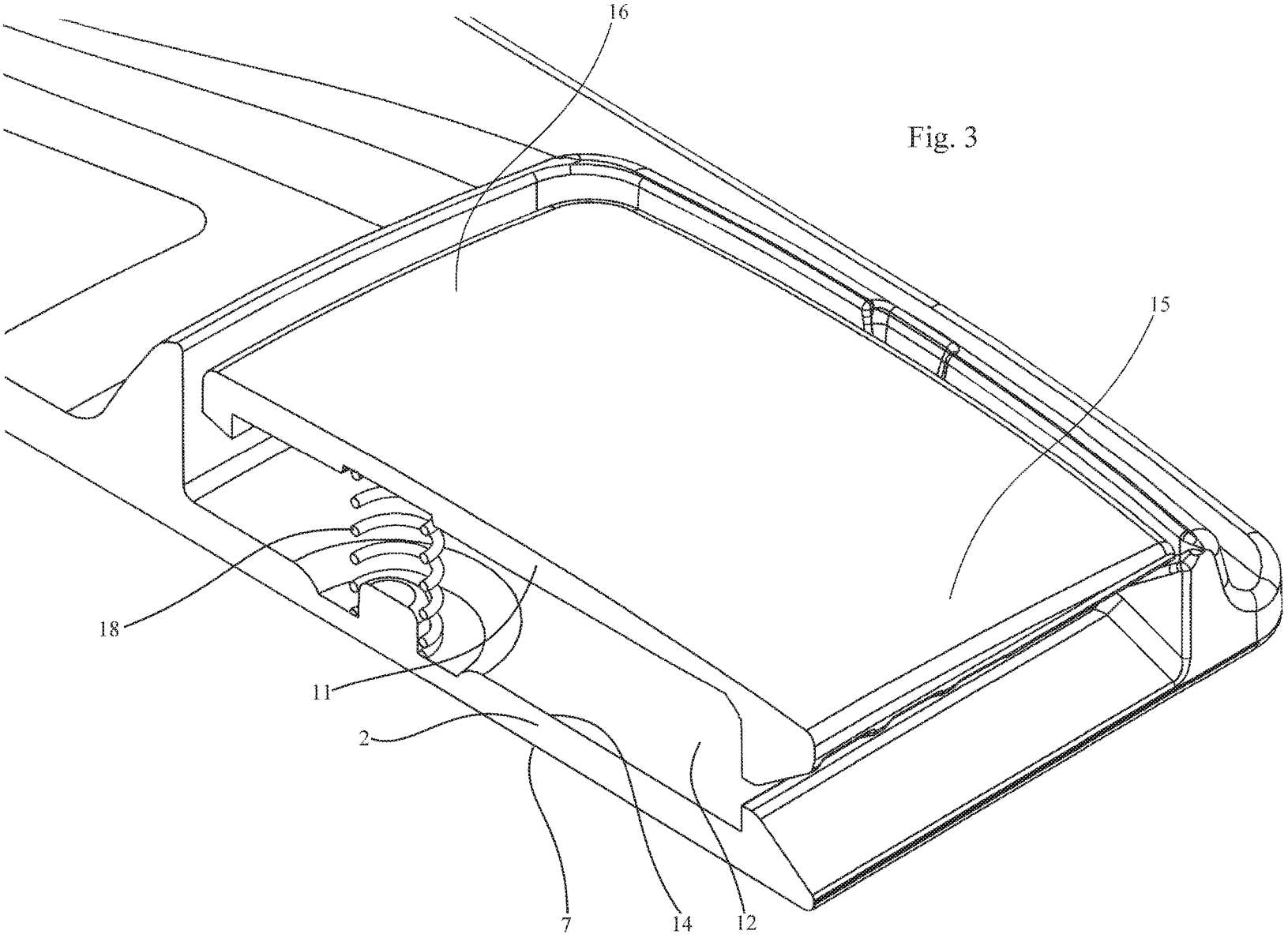
FIG. 3 shows a section along a vertical plane parallel to the longitudinal side of the base and approximately mid-center, which shows the positioning of the cavity interposed between the coupling device and the outer surface of the half-frame; furthermore, we can see the structure of the coupling device present on the opposite side to the active one, consisting of a double lever, the first arm of which realizes the opening mouth together with the transverse end edge of the half-frame, and the second of which, opposite to the first with respect to the approximately central fulcrum point, is above the elastic devices which normally keep the opening mouth, constituted by the first lever, closed.
Figure 4:
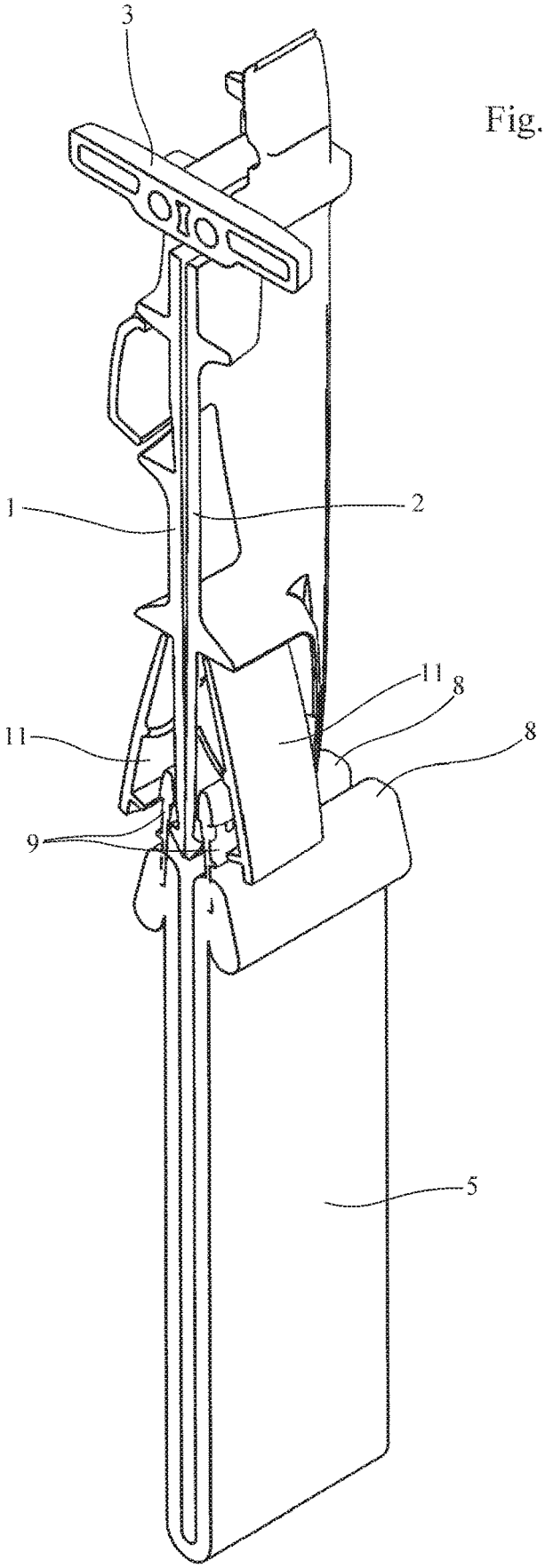
FIG. 4 shows, a section view of the base for mops in a maintenance configuration, with the half-frames rotated in a reclined manner and lowered, and the active surfaces joined together; the cloth hangs with its terminal ends on the coupling devices on the outer surface of the half-frames.
Figure 5:
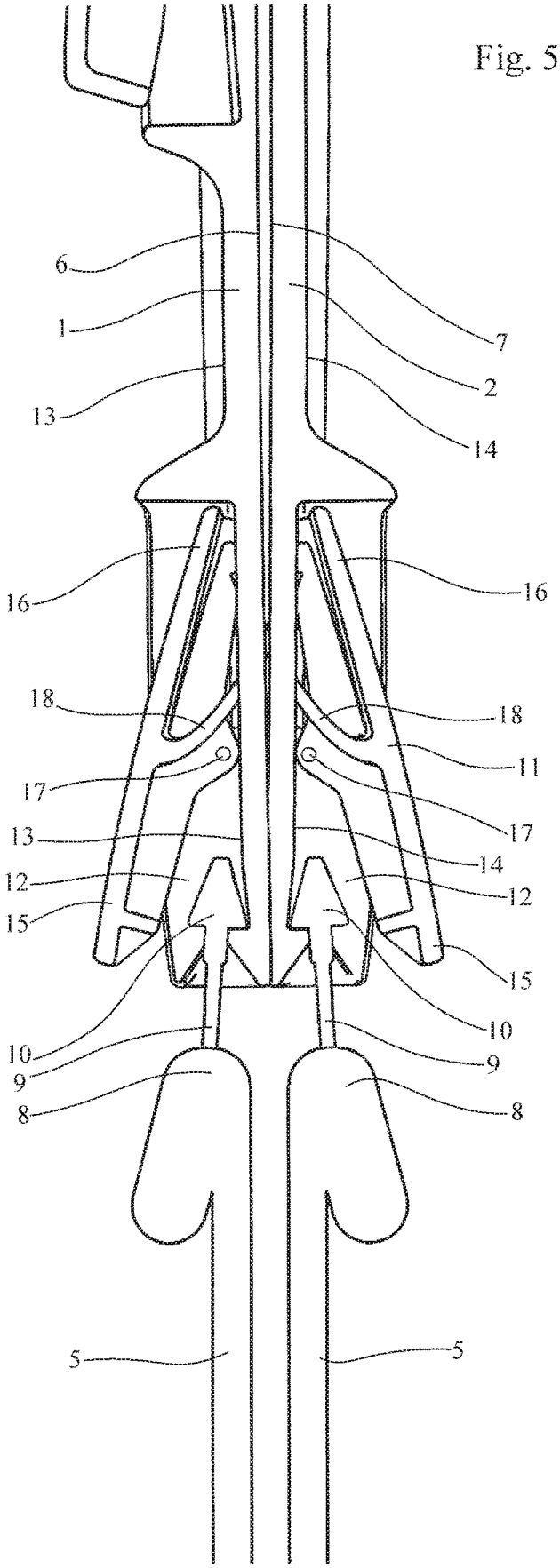
FIG. 5 shows a flat plan view of what is shown in FIG. 4, from which the specular and opposite positioning of the coupling devices is evident.
Figure 6:
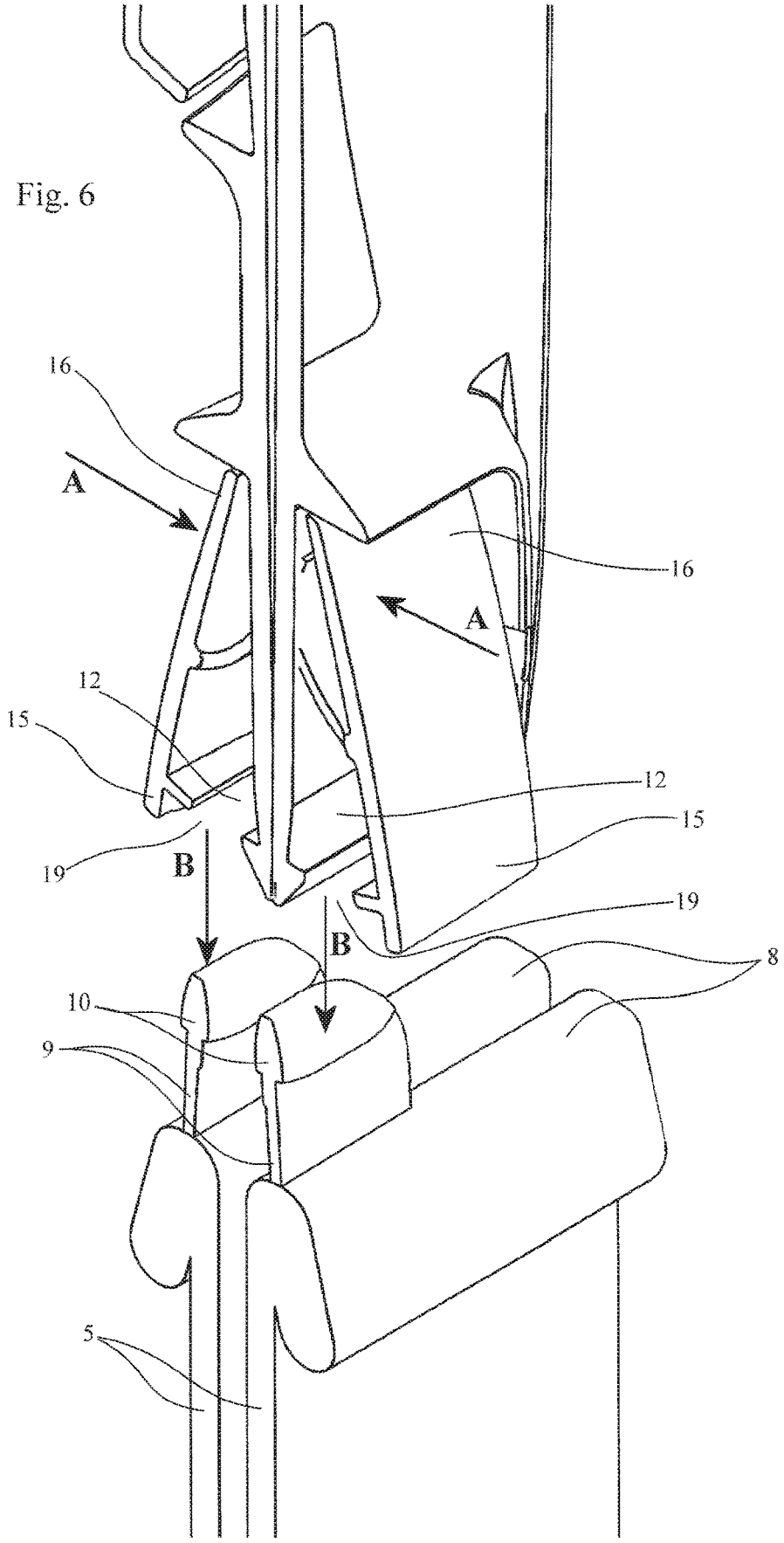
FIG. 6 shows, in an enlarged manner, the connection part of the ends of the cloth shown in FIG. 4, graphically representing the opposing forces A acting on the second lever, which open wide the inlet mouth and the consequent release by the falling, according to the movement represented by the arrows B, of the ends of the cloth.
Figure 7:
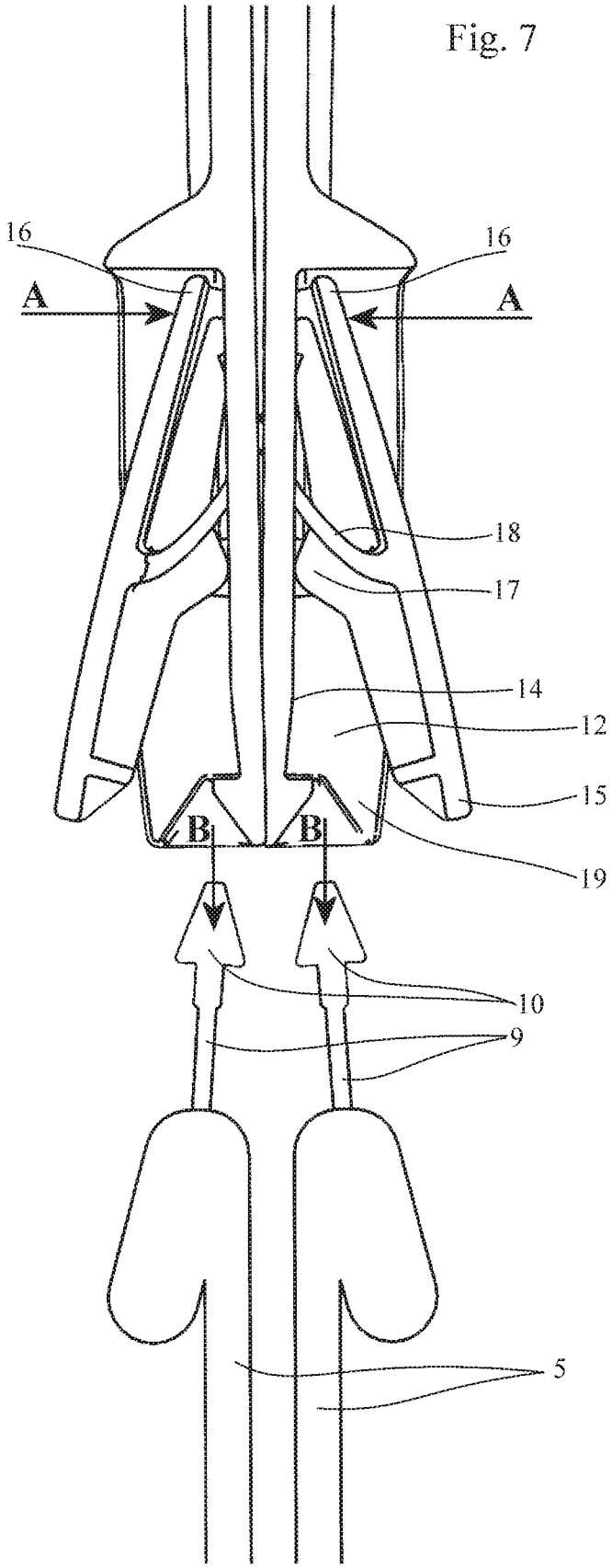
FIG. 7 shows what is set out in FIG. 6 according to a plan view, which explicitly highlights the opposite direction of the pressure forces A on the second lever, and the falling, in the direction of the arrows B, of the ends of the cloth, having opened the cavity formed between the first lever, and below it, and the terminal part, towards the free transverse edge, of the half-frame, which is able to accommodate the enlarged end of the lamina that joins to the transverse side of the cloth.

With reference to the figures, the base is composed of two half-frames 1, 2 hinged at one end of a side transverse to a common central element 3.

The sleeve 4 is connected to this central element 3.

The half-frames 1, 2 constrained in the flat configuration, keep the cleaning cloth 5 taut on their active surface 6, 7, namely on the surface that will be facing the floor, with the cloth 5 interposed, during normal cleaning operations.

Said cloth 5 is held at the base by its transverse ends.

Each of these transverse ends of the cloth 5, in order to be connected to the base, bring to a cantilevered continuation a laminar, or tab, extension, consisting of a lamina 9 whose free end has an enlargement 10.

This enlargement 10 is intended to be retained by the connecting devices 11 within a suitable seat configured as a retention cavity 12 comprised and defined between the same coupling elements 11 and the outer surface 13, 14, opposite to the active surface 6, 7, of each half-frame 1, 2.

Said connecting devices 11 are on the free transverse ends of each of the two half-frames 1, 2; and are configured as a rocker arm formed by a double lever 15, 16 and pivoted, with axis 17 parallel to the transverse edge, on said half-frame 2.

The terminal end of the first lever arm 15, facing the edge of the transverse free end of the half-frame 2, forms, together with the free transverse end of the half-frame 2, an inlet mouth 19 for inserting the lamina 9 with the enlarged end 10.

Said inlet mouth 19 is normally kept closed by elastic devices 18 acting on the second lever arm 16 opposite the first lever 15.

Therefore the inlet mouth 19, kept constantly closed by the elastic devices 18, acts as a clamp on the lamina 9.

The second lever arm 16, opposite the first lever 15, is slightly spaced apart and raised with respect to the underlying surface 14 of the half-frame 2, so that it can be pressed (as shown by the arrows A) by the operator, acting on the surface facing outwards, overcoming the force of the elastic devices 18 and opening the inlet mouth 19 and retaining the transverse ends 8 of the cloth 5.

The opening of the mouth 19 creates a large enough gap to make the enlargement 10 of the lamina 9 itself pass through with a rectilinear movement, along the axis of the lamina 9.

In a coupling phase between the tab and the coupling device, with the tab that has passed the mouth 9 and reached the cavity 12 of the seat reached, the enlargement 10 remains retained, allowing the first lever arm 15 to return, under the pressure of the elastic devices 18, to its normal closed configuration.

One of the prerogatives of an automatic coupling of the cloth 5 to the base is therefore released, since it does not require the operator to perform other operations (usually the case in the devices of the prior art) in addition to the aforementioned ones: it is not necessary to move the end part of the cloth to connect to pegs or undercuts, or carry out other operations to keep the cloth held at the base.

The release of the cloth from the base is even more practical and simplified with the base that is the object of the invention.

From the situation of the base in a maintenance configuration, namely with the half-frames 1, 2 left free to oscillate downwards, and with the active surfaces 6, 7 facing each other, next to each other or close to each other, the coupling devices 11 are mirrored on the outer surfaces 13, 14 of the half-frames 1, 2.

At this point the operator with a single hand is able to use both second arms of the levers 16 of both the coupling/release devices 11 simultaneously, applying pressure, shown with the arrows A, which will act on each single lever 16 in a counter and opposite direction, being able to raise opening wide the mouth 19 of both coupling/release devices 11.

The cloth 5, whose enlargements 10 are no longer retained in the respective cavities 12 of the seats, can therefore detach from the base and fall to the ground, according to the movement indicated by the arrows B.

All this without the operator having to intervene or handle any part of the cloth 5, which is now dirty, to be removed from the base and replaced with a clean part to continue the cleaning operations.

To improve the retention of the cloth 5 on the base, the coupling mouth 19 includes at least one retention wall facing the fulcrum 17 of the coupling lever, and located either on the free end of the half-frame 1, 2 and/or on the free end of the first lever arm 15 capable of joining with the enlargement 10 on the free cantilevered end of the tab.

Advantageously at least one said retention wall has ab orthogonal position to the lamina 9 of the tab that crosses said coupling mouth 19 capable of connecting to a mirror wall of the end enlargement 10 of the tab, guaranteeing a secure and stable retention of the transverse side of the cleaning cloth 5.

In order to improve the retention of the tab inside the cavity 12, the thickness of the enlargement 10 is at least three times greater than the lamina 9 and preferably divided between the two opposite sides of the tab itself.

What is claimed is:

1. A base for a mop and a cleaning cloth, where said cleaning cloth to be retained on said mop base by coupling devices and having, at transverse ends for connecting to said mop base, connecting tabs, the connecting tabs comprising a lamina with an enlarged end where an end enlargement is thicker, at both a top side and a bottom side of the lamina, than a thickness of said lamina of a free end of the tab, and where said mop base is configured to retain in a removable manner said cleaning cloth and including a pair of half-frames, each hinged to a central connecting element of said base for a rotational movement of said half-frames between a flat position and a reclined position where said half-frames are brought closer together; on each of said half-frames near a free transverse side, opposite the side hinged to the central element, is hinged said coupling device comprising a lever, wherein between a first arm of said lever and the corresponding outer surface of the half-frame there is a cavity that has a cross-section corresponding to the end enlargement of the transverse end the cloth, which is configured with the end enlargement and that tapers into the lamina joining with a body of the cloth coming out of said cavity through an inlet mouth, defined with a first retention wall on the free end of the first arm of said lever and a second retention wall on the end of the free transverse side of a half-frame; whereby when said first arm of said lever is pressed, by an action of elastic devices acting on a second arm of said lever, comes next to the outer surface of the half-frame closing the inlet mouth and keeping said cavity; where the cavity has, near the inlet mouth and facing a fulcrum of the hinging of said lever, a retention wall perpendicular to the tab that crosses said mouth that connects to the outer wall of the end enlargement of the transverse end of the cleaning cloth for a relative retention of the transverse side of the cloth, the retention wall formed from an alignment of the first retention wall and the second retention wall, wherein the first retention wall and the second retention wall form the inlet mouth that provides an insertion direction of the enlarge end into the cavity that is co-planar with a base of the mop base.

2. The base of claim 1, wherein said cavity is below the first arm of said lever, with a same shape as said lever and/or a shape of the outer surface of the half-frame.

3. The base of claim 1, wherein said coupling devices, with the half-frames rotated in a lowered manner and close together for juxtaposing respective active surfaces, in a defined maintenance configuration, they are in a mirror position in order to be operated by overcoming elastic forces of the respective elastic devices acting on the second arm of said levers with two opposing and opposite pressure forces, in order to be able to reach at a same time by use of just one hand of the operator.

4. The base of claim 1, wherein said half-frames, from a planar condition, freed from a mechanical constraint of the base, are arranged side by side free oscillating downwards in a maintenance configuration, with a relative cleaning cloth leaning and held at the ends of the transverse sides, as a result of pressure on the second arm of said lever of the coupling devices, the inlet mouth opens, with an opening wider than the thicker end of a plate, creating an opening of the cavity, and the cloth because of its own weight is released from the base, falling down.

5. The base of claim 1 wherein said coupling devices are of a hinged lever type, an arm of said lever is an actuation lever and an opposing lever arm is the retention device of the tab on the transverse side of the cloth.

6. The base of claim 1, wherein the second arm of an actuation lever is kept under constant stress by elastic devices which keep it at some distance from the outer surface of the half-frame, and an opposite end of the first lever holds with constant pressure, due to the aforesaid elastic devices, the relative lamina of the cloth, pressed for retention against the outer surface of the half-frame.

7. The base of claim 1 wherein the coupling device has a gripper with one side composed of the half-frame and an opposite side composed of a terminal end of the first arm of the retention lever.

8. The base of claim 1 wherein the cloth device consists of the connection between the cavities and relative enlargement of an end part of the lamina on the transverse sides of the cloth, since the relative inlet mouth can open with a larger opening than the enlargement for insertion of said enlargement into a seat.

9. The base of claim 1 wherein the enlarged end enlargement has a thickness that is three times that of the lamina.

10. A cleaning device comprising:

a cleaning cloth having:

connecting tabs having, an enlarged end, at opposite ends thereof; and a lamina joining the connecting tabs to a body of the cleaning cloth, wherein:

the enlarged end has a thickness expanding both above and below a thickness of the lamina;

a mop base having:

a pair of half-frames, each having a first side hinged to a central connecting element of said mop base for a rotational movement of said half-frames between a flat position and a reclined position where said half-frames are brought closer together;

coupling devices on each of said half-frames, near a free transverse side, opposite the first side;

a lever pivotable about a fulcrum, the lever defining a cavity between the fulcrum and an outer surface of the half frame, the cavity have a cross-section adapted to receive the enlarged end;

an inlet mouth providing access to the cavity, the inlet mouth defined by a first retention wall on a free end of the lever and a second retention wall an outer end of the free transverse side of a half-frame;

wherein the cavity has, near the inlet mouth and facing the fulcrum of the hinging of the lever, a retention wall perpendicular to the lamina that crosses said inlet mouth for a relative retention of the enlarge ends of the cleaning cloth, the retention wall formed from an alignment of the first retention wall and the second retention wall, wherein the first retention wall and the second retention wall form the inlet mouth that provides an insertion direction of the enlarge end into the cavity that is co-planar with a base of the mop base.

* * * * *